United States Patent [19]

Jay et al.

[11] 4,032,989

[45] July 5, 1977

[54] GARMENT LINER

[75] Inventors: Aubrey Jay, White Plains; Maurice A. Jacobs, Valley Cottage, both of N.Y.

[73] Assignee: J. C. Penney Company, Inc., New York, N.Y.

[22] Filed: Nov. 8, 1974

[21] Appl. No.: 522,318

[52] U.S. Cl. ..... 2/73

[51] Int. Cl.[2] ..... A41B 9/10

[58] Field of Search ..... 2/73, 74, 75, 211

[56] References Cited

UNITED STATES PATENTS

| | | | |
|---|---|---|---|
| 2,194,181 | 3/1940 | Jasper | 2/73 |
| 2,292,982 | 8/1942 | Wood | 2/73 |
| 2,357,794 | 9/1944 | Diamond | 2/73 |
| 2,396,117 | 3/1946 | Novy | 2/73 |
| 2,434,112 | 1/1948 | Klein | 2/73 |
| 2,443,483 | 6/1948 | Shaw | 2/73 |
| 2,701,363 | 2/1955 | Roodner | 2/73 |
| 3,176,692 | 4/1965 | Marino | 2/73 X |

*Primary Examiner*—H. Hampton Hunter
*Attorney, Agent, or Firm*—Pennie & Edmonds

[57] ABSTRACT

A garment liner adapted for encompassing the body of a wearer embodying a first set of biased-cut panel means including first and second biased-cut side panel means and a second set of unbiased-cut panel means including front and back panel means. The first and second biased-cut side panel means are, respectively, connected to opposed edges of the front panel means, while the back panel means interconnects the first and second panel means to thereby form a garment liner adaptable to encompass the body of a wearer. Each of the first and second panel means is arranged to encompass opposite zones of the side of the body from at least along a portion of a generally vertical line passing through the nipple of a breast and a generally medial portion extending along the front of the leg to at least along a portion of a generally vertical line which extends along a shoulder blade to a generally medial portion extending along the back of each leg.

10 Claims, 4 Drawing Figures

GARMENT LINER

BACKGROUND OF THE INVENTION

1. Field of the Invention

The present invention is generally directed to garment liners and, more particularly, it is directed to slips, halfslips, camisoles, pant liners, and the like.

2. Description of the Prior Art

Certain heretofore known types of garment liners, especially those adapted for use as women's undergarments, do not have the capacity to snugly conform to the wide variations in the shapes and sizes of the users thereof. Traditionally, garment liners, such as slips, are manufactured in standard sizes, which sizes more or less dimensionally encompass one particular feature of a wearer but, however, do not provide a snug fit for the noted wide variations in shape of the wearer. In addition, the bust and sides of the torso, such as the hips, buttocks and thighs of a user, can change, as by expansion even after purchasing a slip. As can be appreciated, these slips manufactured in such standard sizes fail to adequately conform to such changes in the contour of the wearer's body. Consequently, these garment liners do not provide for a slip which has the capability of furnishing an overall type of flattering form-fit which produces a slenderizing effect for the wearer.

Moreover, with respect to garment liners, such as slips and half-slips, there is a tendency for such types of garment liners to ride up on a wearer. This kind of riding action is primarily due to the fact that the slips do not relatively tightly conform to the wearer's body. Inasmuch as such riding action causes the slip material to gather or bunch up, the corresponding accumulation of material can become outwardly visible. Thusly, the otherwise smooth external and aesthetic appearance of an outer garment, such as a dress or skirt, becomes disrupted. Accordingly, it may frequently become an annoyance for women to constantly attend to the elimination of the aforementioned disadvantages associated with the accumulation of material.

Other shortcomings associated with prior art garment liners, such as slips and camisoles, is the fact that they fail to relatively tightly conform to the configurations of the breasts of many women whose breasts tend to displace laterally outwardly. Hence, the slip does not provide a slenderizing form-fit appearance for the wearer. By way of specific example, one prior art approach to remedy this shortcoming is generally described in U.S. Pat. No. 2,701,363, wherein a slip is provided with gusset-like insert panels in the bodice section for supporting a woman's bust. Although this slip is directed to support of the busts, it does not conform to other portions of the wearer's body, thereby providing less than a completely satisfactory slip. Moreover, such slip required added material in the form of gusset panels, therefore necessitating additional costs for fabric and labor.

A further example of another approach made in prior art manufactured slips is described generally in U.S. Pat. No. 2,404,451. While the particular slip therein described employed biased-cut side panels, such slip has to be provided with plaits in the bodice section for purposes of having a form-fit. In addition, this slip does not provide for encompassing and conforming to other portions of the wearer's anatomy, such as the thighs, hips, and buttocks or to conform to the variations in the anatomy of individual women. As can be appreciated, this slip, as with the one previously noted, provides less than a completely satisfactory fit.

SUMMARY OF THE INVENTION

Accordingly, the present invention is directed to a novel and improved garment liner which overcomes the previously mentioned shortcomings typically associated with such prior art garment liners.

Briefly stated, the garment liner of this invention is adapted to provide the capability of conforming to as well as encompassing the wearer's body and may include a first set of generally elongated biased-cut panel means including first and second biased-cut stretchable side panel means and a second set of generally elongated straight-cut panel means including front and back panel means. The first and second biased-cut side panel means are, respectively, connected to opposed edges of the front panel means while the back panel means serves to interconnect the first and second biased-cut side panels means. By such a constructional arrangement, a garment liner is suitable for encompassing the body of a wearer. Each of the stretchable first and second side panel means is contemplated for encompassing opposite sides or lateral zones of the body, commencing from at least along a portion of a generally vertical line passing approximately through a generally medial portion of a breast and coinciding with a front generally medial portion extending along the front of the leg and terminating at least along a portion of a corresponding back generally vertical line which extends along the shoulder blade and coincides with a rear generally medial portion extending along the back of the leg. Although one preferred embodiment is intended to conform to the lateral contours of women's breasts, such garment liners as contemplated for use in the invention need not be provided with breast sections. Preferably the vertical line passes through the nipple of the breast.

In applicant's above-noted arrangement, substantial portions of a wearer's body are enabled to be rather tightly and closely conformed to by a simple to manufacture, inexpensive, yet form-fitting garment liner which is, by virtue of its stretchable arrangement, capable of being adaptable to various types of and changes in the shapes and sizes of particular anatomical features intended to be covered by the slip.

BRIEF DESCRIPTION OF THE DRAWINGS

The above as well as other objects, features, and advantages of a novel and improved slip made in accordance with the principles of the present invention will be readily understood upon a reading of the following detailed description of the present invention made viewed in conjunction with the accompanying drawings, wherein like reference numerals indicate like structure throughout the several views.

DESCRIPTION OF THE PREFERRED EMBODIMENTS

Figure 1:
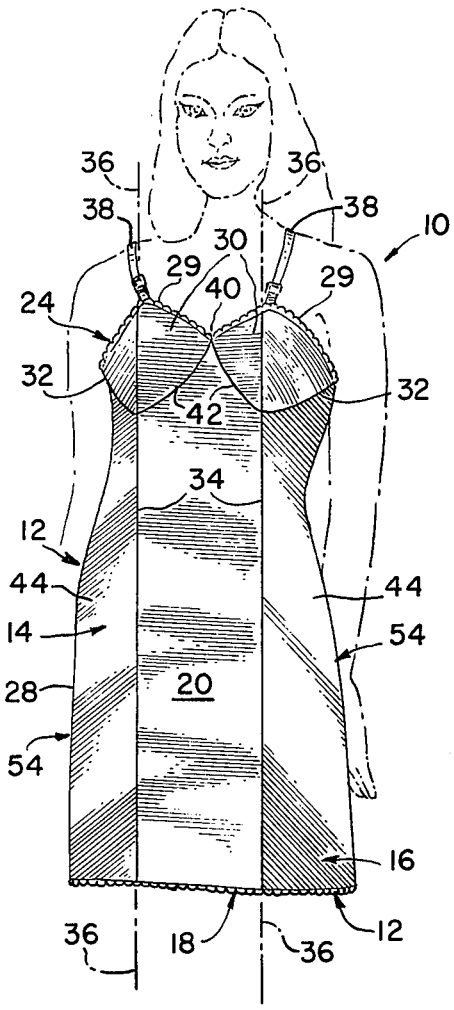
FIG. 1 is a frontal view of a female wearing a preferred embodiment of a garment liner made in accordance with the principles of the present invention.

Referring now to the drawing, there is disclosed a garment liner embodying the principles of the present invention and designated generally by reference numeral 10. Such garment liner 10 as herein disclosed in the succeeding description of the preferred embodiment is a slip of the type which is especially adapted for enabling the encompassing and form-fitting of the wide variations in the shape and size of the feminine wearer. It is, of course, understood that the other types of garment liners, such as half-slips, camisoles, and pant liners may be manufactured in accordance with the spirit and scope of this invention. Accordingly, the description of a slip 10 is offered for purposes of illustration and not for limitation. It is to be further understood that appropriate categories of garment liners which may be worn by men, as for example pant liners, may also be produced without departing from the theory and practice of the present invention.

Figure 3:
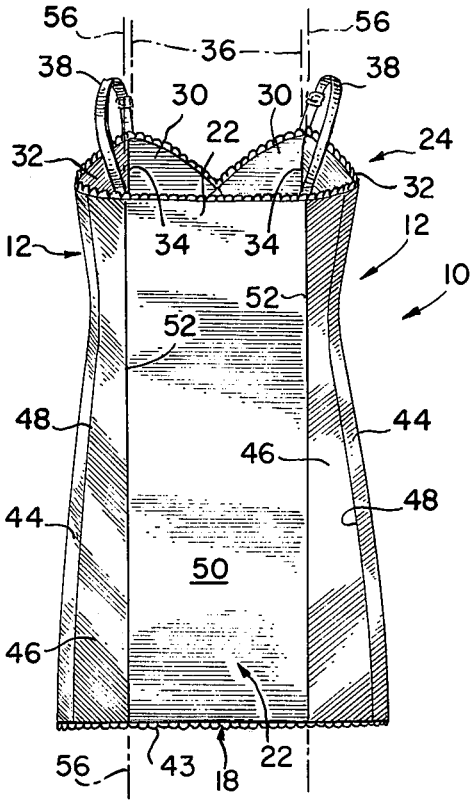
FIG. 3 is a rear elevational view of the garment liner as illustrated in FIGS. 1 and 2.
Figure 2:
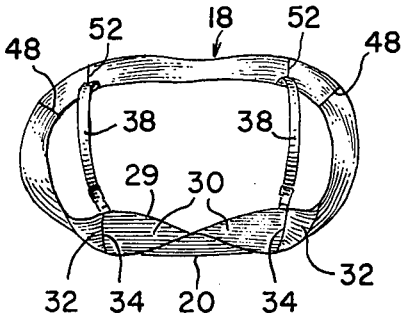
FIG. 2 is a plan view of the garment liner illustrated in FIG. 1.

With reference to FIG. 1 taken along with FIGS. 2 and 3, the novel and improved slip 10 essentially includes a first set of generally elongated panel means 12 including first and second side panel means 14 and 16, respectively, and a second set of panel means 18 including front and back panels 20 and 22, respectively. Such first and second sets of panels 12 and 18 are interconnected in a manner to be presently set forth to define a bodice section 24 and which has connected thereto a depending skirt section 28. The slip 10 contemplated by this embodiment may be fabricated from any suitable woven or knitted type of fabric material.

The bodice section 24 includes two separate breast cup portions 29, each of which are appropriately formed to adapt to the breasts of the wearer. Each breast cup portion 29 is, in turn, defined by inner and outer bodice panels 30 and 32, respectively. These inner and outer bodice panels 30 and 32, respectively, define a portion of the front panel means 20 and the first and second side panel means 14 and 16, respectively, and have a generally triangular configuration. Such inner and outer bodice panels 30 and 32, respectively, are suitably joined together along juxtaposed edges by a vertical seam 34 in a well-known fashion. At this point, it should be emphasized that both inner bodice panels 30 are made from material which is defined by an unbiased cut, whereas the outer bodice panels 32 are formed from a material cut on the bias. As is generally well-known in this particular art, biased pieces, by virtue of the manner in which they are sewn in on the bias in the garment, behave substantially more elastic than unbiased pieces. By such an arrangement, it can be appreciated that the outer bodice panels 32 are enabled to, by virtue of their elastic or stretch properties, to closely conform to the variations in the size and shape of the breasts. Vertical seams 34 of this particular embodiment are designed to generally coincide with front generally vertical lines 36 which extend through respective nipples of the breasts and along a generally medial front portion of each leg of the wearer. Respective ones of a pair of straps 38 support the slip 10 on the wearer and are suitably fastened at their front ends to each of the breast cup portions 29 while the rearward ends are appropriately fastened to the depending skirt portion 28.

Particularly referring to FIGS. 1 and 3, the front panel means 20 has a top end which defines an apex section 40 and generally concave shaped edges 42. The edges 42 are appropriately connected to respective inner bodice panels 30 in a conventional manner. Such front panel means 20 are defined by straight-cut material. Typically, the straight-cut front panel means 20 whenever used in this kind of an arrangement normally serves to generally flatten the midriff of the wearer. Although only a single front panel means 20 has been disclosed, as is known in the art, a plurality of panels may be appropriately joined to comprise the front panel means. The vertical seams 34 extend downwardly to the bottom edge or hemline 43 of slip 10 and interconnect ones of the first and second side panel means 14 and 16, respectively, to the longitudinal edges of the front panel means 20.

As aforementioned, the first set of side panel means 12 are fabricated from a suitable bias-cut material for purposes to be presently described. In the instant embodiment, the first and second side panel means 14 and 16 are each defined by a pair of biased-cut panels 44 and 46, respectively. The panels 44 and 46 are appropriately connected together by vertical seams 48.

Although the preferred embodiment discloses that the first and second side panel means 14 and 16, respectively, are defined by two panels 44 and 46, it is understood that the side panel means may be defined by a singular panel or three or more panels provided, of course, that each of the forming panels be manufactured by material cut on the bias. Furthermore, although in the preferred embodiment, the bias of the cut of each panel 44 and 46 is in a similar direction, such need not be the case. In fact, the bias of the cut in each panel 44 and 46 may assume various relationships with respect to each other, such as a herringbone pattern indicated in FIG. 4. As noted in FIGS. 1 and 4, the cut of the bias of the outer bodice panels 32 extend in a similar direction to the cut of the bias of the side panels 44. In this manner, the outer bodice panels 32 are better enabled to conform, by stretching, to the lateral configurations of the breasts. Accordingly, if the breasts should laterally bulge outwardly, the lateral zones defined by the biased-cut first and second side panel means interconnected between the front and back panel means, by virtue of their elasticity, serve to stretch and thereby firmly press against the lateral sides of the breasts. In this fashion, they form a tight-fit with the breasts as well as provide some support therefor.

As can be appreciated, such of the first and second side panel means 14 and 16, respectively, of the preferred embodiment are adapted to conform by stretching to the lateral portions of the wearer.

As depicted in FIG. 3, the back panel means 22 is defined by a single panel 50 which has appropriate material that is straight-cut. Rear seams 52 serve to appropriately interconnect the rear panel 50 with each of the first and second side panel means 14 and 16 to thereby form a garment liner which encompasses the wearer's body. It is contemplated that such of the side panel means 14 and 16 generally encompass lateral zones of the wearer's body. These lateral zones are generally indicated by reference numeral 54, and extend from at least along a portion of the front generally vertical lines 36 which, as aforenoted, extend through the nipple of each breast and coincides with the front generally medial portion extending along the front of the legs to at least along portions of respective rear generally vertical lines 56 which extend generally medially through each shoulder blade and respective rear generally medial portions extending along the back of each leg.

In the preferred embodiment of the slip 10, each of the first and second side panel, means 14 amd 16, respectively, is arranged such that hemline 43 depends to an area of the thigh which is about 3 inches or 7.6 centimeters above the knees. By this particular arrangement, the slip 10 has capability of adapting to differences in the thighs of individuals.

Furthermore, by the arrangement of the biased-cut first and second side panel means 14 and 16, respectively, encompassing the opposite side zones 54 as aforedescribed, the slip 10 is enabled to tightly conform to substantial portions of the thighs, buttocks, hips, sides of the torso, and breasts. Although the hemline 43 has been described as extending to about 7.6 centimeters above the knee, the present invention envisions that the hemline 43 may extend to other suitable distances above the knee, preferably, so long as the portion of the thigh having the greatest size is encompassed.

Figure 4:
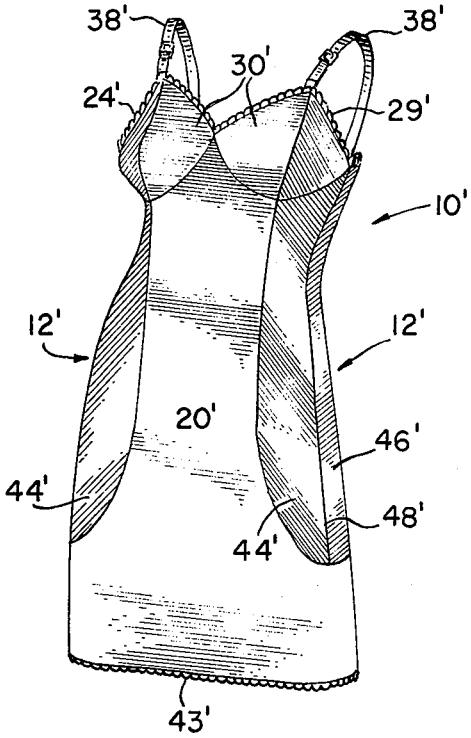
FIG. 4 is a partial perspective view of an alternate embodiment of a garment liner similar to the one illustrated in FIGS. 1 to 3.

Referring to FIG. 4 of the drawings, an alternate embodiment of a slip embodying the principles of the present invention is disclosed. Since it is similar in many respects to the slip of the previously-mentioned embodiment, like reference numerals will indicate like structure with, however, the addition of prime markings. Basically, this particular embodiment differs from the previous one in that both the first and second side-biased-cut panel means 14' and 16', instead of extending to the bottom hem 43' of the depending skirt portion 29', are somewhat shortened and flare or taper generally downwardly.

Although the tapered side panels 44' and 46' do not extend to the bottom hemline 43', they do extend below the hips and buttocks as well as encompass relatively substantial portions of the thighs wherein most of the size is maintained. Thusly, it is also enabled to provide a form-fit which is capable of conforming to the wide variations existing in the generally lateral portions of the wearer's body.

In the aforenoted constructional arrangement, by arranging the first and second set of panels in the manner indicated above, a garment liner is provided which provides an aesthetic form-fit and which is adaptable to conform to various sized and shaped bodies.

What is claimed is:

1. A form fitting undergarment which comprises a bodice section and a depending skirt section connected thereto, said bodice section including two bust covering portions, each comprising inner and outer bust panels, said skirt portion including at least a front panel and at least a pair of opposed side panels connected to opposite edge portions of said front panel, and a rear panel interconnecting said opposite side panels, said inner bust covering panels, said front panel, and said back panel being formed of a straight-cut material having generally straight cut edge portions, said outer bust panels and said opposed side panels being formed of a biased cut material having generally biased-cut edge portions biasing the corresponding side and bust panels, said bias-cut of said outer bust panels extending in substantially the same direction as the bias-cut of said opposed side panels at least along a portion defined by a generally vertical line extending generally medially of each breast of a wearer and respective front medial portions along the legs, said bust and side panels further extending respectively over side zones of the body along at least a portion of a vertical line extending generally medially of each respective shoulder blade of the wearer and longitudinally along a rear medial portion of each respective leg to form a snugly encompassing relation with the body of a wearer due to the substantially vertical interconnecting edge portions of said panels and the elastic properties exhibited by said bias-cut side and bust panels.

2. A undergarment as set forth in claim 1, wherein said side panels are comprised of a first and second interconnected side panels which have different bias-cuts with respect to each other, and said first side panel has a bias-cut which is substantially in the same direction as the bias-cut of the said outer bust panel.

3. The undergarment as set forth in claim 2 wherein said side panels extend to a portion of each thigh which at least includes the greatest size.

4. The undergarment as set forth in claim 3 wherein said side panels extend to an area below a portion of each thigh which at least includes the greater size, but above the knees.

5. The undergarment as set forth in claim 4 wherein said side panels extend to an area approximately 7.6 centimeters above the knees.

6. The undergarment as set forth in claim 3 in which said side panels extend to an area below the knees.

7. An undergarment which comprises a first pair of generally elongated biased-cut elastic side panels having generally parallel biased-cut edge portions, a second pair of oppositely positioned front and rear straight-cut panels having generally parallel straight-cut edge portions, said first and second biased-cut side panels being respectively connected to opposed straight-cut edge portions of said straight-cut front panel and said rear panel being connected to said first and second biased-cut side panels along the respective biased-cut edge portions thereof such that at least said first and second side panels snugly encompass opposite side zones of a body and such that said edge portions of said front panel extend over a generally medial portion of a respective breast and along a generally vertical line passing approximately through the generally medial portion of the breast and a front generally medial portion of the corresponding leg to respective vertical lines extending generally along a respective shoulder blade and through a rear generally medial portion of the respective leg such that the garment snugly conforms to the body due to the substantially vertical interconnecting panel edge portions thereof and the elastic properties exhibited by said biased-cut side panels.

8. The undergarment as set forth in claim 7 wherein said opposed edge portions pass over a nipple of a breast and along respective ones of said generally vertical and parallel lines.

9. An undergarment which comprises a first pair of generally elongated biased-cut elastic side panels having generally parallel edge portions extending along substantially the entire length of the undergarment, a second pair of oppositely positioned front and rear straight-cut panels having generally parallel edge portions, said first and second biased-cut side panels being respectively connected at opposed straight-cut edge portions of said straight-cut front panel and said rear panel being connected to said first and second biased-cut side panels along the respective biased-cut edge portions thereof such that at least said first and second side panels snugly encompass opposite side zones of a body from at least along a portion defined by a generally vertical line extending generally medially of a breast and a front generally medial portion of the corresponding leg to respective vertical lines extending generally along a respective shoulder blade and through a rear generally medial portion of the respective leg such that the garment snugly conforms to the body due to the substantially vertical interconnecting panel edge portions thereof and the elastic properties exhibited by said biased-cut side panels, said biased-cut side panels extending to an area below the buttocks and a portion of each thigh which at least includes the greater size but above the knees.

10. An undergarment which comprises a first pair of generally elongated biased-cut elastic side panels having generally parallel edge portions, a second pair of oppositely positioned front and rear straight-cut panels having generally parallel edge portions, said first and second biased-cut side panels being respectively connected to at least along a portion of opposed straight-cut edge portions of said straight-cut front panel, and said rear panel being connected to said first and second biased-cut side panels at least along a portion of the respective biased-cut edge portions thereof, said front panel having a remaining portion of its respective edge portions connected to corresponding remaining edge portions of said rear panel such that at least said first and second side panels snugly encompass opposite side zones of a body and such that said edge portions of said front panel extend over a generally medial portion of a respective breast and along a generally vertical line passing approximately through the generally medial portion of the breast and a front generally medial portion of the corresponding leg to respective vertical lines extending generally along a respective shoulder blade and through a rear generally medial portion of the respective leg such that the garment snugly conforms to the body due to the substantially vertical interconnecting panel edge portions thereof and the elastic properties exhibited by said biased-cut side panels.

* * * * *